US006619096B1

(12) United States Patent
Hartley et al.

(10) Patent No.: US 6,619,096 B1
(45) Date of Patent: Sep. 16, 2003

(54) DIE POST ASSEMBLY

(75) Inventors: William R. Hartley, Macomb, MI (US); Timothy A. VerVaecke, New Baltimore, MI (US)

(73) Assignee: UNOVA IP Corp., Woodland Hills, CA (US)

( * ) Notice: Subject to any disclaimer, the term of this patent is extended or adjusted under 35 U.S.C. 154(b) by 0 days.

(21) Appl. No.: 09/640,447

(22) Filed: Aug. 17, 2000

Related U.S. Application Data

(60) Provisional application No. 60/158,291, filed on Oct. 8, 1999.

(51) Int. Cl.[7] ..... B21D 5/01; B21D 5/02

(52) U.S. Cl. ..... 72/316; 29/243.58

(58) Field of Search ..... 72/316, 322, 323, 72/319, 211, 214, 386; 29/243.58, 243.57, 243.5

(56) References Cited

U.S. PATENT DOCUMENTS

| | | | | | |
|---|---|---|---|---|---|
| 1,693,643 | A | * | 12/1928 | D'Ardenne | 29/243.57 |
| 1,744,391 | A | * | 1/1930 | Kuehn | 72/319 |
| 2,803,152 | A | * | 8/1957 | Wales | 76/107.1 |
| 3,524,363 | A | * | 8/1970 | Wertepny | 76/106.5 |
| 4,435,901 | A | * | 3/1984 | Nishikawa | 76/106.5 |
| 5,247,861 | A | * | 9/1993 | Jahn | 76/107.1 |
| 5,505,069 | A | * | 4/1996 | Break et al. | 72/319 |
| 5,715,722 | A | * | 2/1998 | Morley | 269/228 |
| 6,295,858 | B1 | * | 10/2001 | Torito | 29/243.58 |

FOREIGN PATENT DOCUMENTS

| | | | |
|---|---|---|---|
| JP | 3-216219 | * | 9/1991 |
| JP | 3-226316 | * | 10/1991 |

* cited by examiner

*Primary Examiner*—Daniel C. Crane
(74) *Attorney, Agent, or Firm*—Reising, Ethington, Barnes, Kisselle, P.C.

(57) ABSTRACT

A die post assembly that supports a metal panel in a position to allow an implement such as a roller or die steel to flange, pre-hem or hem an edge of the panel. A die post support surface is disposed on a panel support element and an edge member of the assembly. The die post support surface is shaped to support the panel and includes a bearing surface that supports an overlying portion of the panel against deformation as the marginal edge portion of the panel is bent in a flanging or hemming operation. The edge member includes the bearing surface and is supported on the panel support element. The edge member comprises a material more durable than the material of the panel support element. This material is sufficiently durable to allow the edge member to support a series of metal panels over a large number of hemming or flanging cycles without flowing or otherwise deforming due to heat and pressures typically generated in such operations.

19 Claims, 7 Drawing Sheets

DIE POST ASSEMBLY

REFERENCE TO PROVISIONAL PATENT APPLICATION

This application claims the benefit of Provisional Patent Application U.S. Ser. No. 60/158,291 filed Oct. 8, 1999.

TECHNICAL FIELD

This invention relates generally to a die post assembly for supporting a thin metal panel in a position to allow a hemming implement such as a roller or die steel to flange and/or hem at least a portion of a marginal edge portion of the panel.

BACKGROUND OF THE INVENTION

Die posts are used in hemming machines to support thin metal panels such as automobile body panels in positions that allow hemming or flanging implements such as rollers or die steels to flange and/or hem at least a portion of peripheral edges of the panels.

Many die posts are of all-metal construction and are made by casting hardenable iron. In a die post of this type, hardenable iron is cast into a shape that includes a support surface. The support surface is shaped to complement and support a portion of a metal panel while allowing a marginal edge portion of the metal panel to be flanged, hemmed, or roll formed to a finished configuration. Such die posts also generally include a bearing region comprising at least a portion of an outer marginal portion or peripheral edge region of the die post support surface. The bearing region supports a portion of a metal panel overlying the bearing region against deformation as the marginal edge portion of the metal panel is flanged or hemmed. However, cast metal die posts are quite massive and cannot be easily moved from one location to another without special lifting equipment. Neither can such die posts be manually lifted into position during assembly in a hemming apparatus. Because of their weight, cast die posts require heavy support members to support them in a hemming apparatus. Moreover, cast metal lacks dimensionally stability after casting and must be set aside for approximately six weeks before machining to within final tolerances.

Some die posts constructed for low-volume applications such as prototype dies are all-plastic in composition. Such die posts may be constructed by cutting and bonding together filled urethane tooling planks to form a rough approximation of the desired shape of a support surface. The support surface is then machined to a desired complementary shape. As with cast metal die posts, a bearing region comprises an outer portion of the support surface of the die and supports a portion of a metal panel overlying the bearing region against deformation as adjacent portions of the panel are being stamped or bent to a desire shape. However, die posts having plastic bearing regions are unable to support a portion of each of a series of metal panels against deformation over a large number of cycles without flowing due to heat or pressures generated in an edge flanging or hemming process.

What is needed is a die post that can be easily moved from one location to another without special lifting equipment and can be lifted into position using a fork truck or electric hoist during assembly in a hemming apparatus. It is also desirable that such a die post be supportable in a hemming apparatus without heavy support members. Still further, it is desirable that such a die post be more dimensionally stable than cast iron while retaining the capability to withstand a large number of cycles.

SUMMARY OF THE INVENTION

According to the invention, a die post assembly is provided for supporting a thin metal panel in a position to allow a hemming implement such as a roller or die steel to flange, pre-hem or hem a marginal edge portion of the panel. The assembly includes a die post support surface configured to support a metal panel to be flanged, pre-hemmed or hemmed. The die post support surface is configured to allow a marginal edge portion of the metal panel to extend beyond an edge of the die post support surface when the die post is used to support a metal panel during flanging operations. The die post support surface includes a bearing region disposed adjacent the edge of the die post support surface and is configured to support an overlying portion of the panel adjacent the marginal edge portion of the metal panel against deformation as the marginal edge portion of the metal panel is bent in a flanging, pre-hemming or hemming operation. The assembly also includes a panel support element comprising a first material and including an inner region of the die post support surface.

Unlike the prior art, the assembly also includes an edge member supported on the panel support element. The edge member includes the bearing region of the die post support surface and comprises a second material more durable than the first material.

According to another aspect of the invention, a hemming die apparatus is provided for supporting a thin metal panel in a position to allow a hemming implement such as a roller or die steel to flange or hem at least a portion of an edge of the panel. The hemming die apparatus comprises a die post configured to support a metal panel to be flanged or hemmed in a flanging or hemming operation. The apparatus also includes a die post support assembly configured to removably support the die post for pivotal motion between a generally upright installation position and a work position for hemming or flanging a thin metal panel supported on the die post. The die post may, according to the invention, be installed and removed in a generally upright (vertical or slightly inclined) position rather than being lifted off of or onto the support assembly in the prone or generally horizontal position.

According to another aspect of the invention, a method is provided for making the die post assembly. The method includes providing a panel support element comprising a first material, providing an edge member comprising a second material more durable than the first material and assembling the die post by supporting the edge member on the panel support element.

Objects, features and advantages of this invention include the ability for the die post to support a series of metal panels in a flanging, pre-hemming or hemming operation over a large number of cycles without flowing or deforming the bearing region of the die post support surface as a result of such factors as heat or pressures generated in a hemming or flanging process; reducing effort required to move the die post and structural requirements of the die post support assembly and reducing effort required to install and remove die posts on a die post support assembly.

BRIEF DESCRIPTION OF THE DRAWINGS

These and other objects, features and advantages of this invention will be apparent from the following detailed description of the preferred embodiments and best mode, appended claims, and accompanying drawings in which:

DETAILED DESCRIPTION

Figure 1:
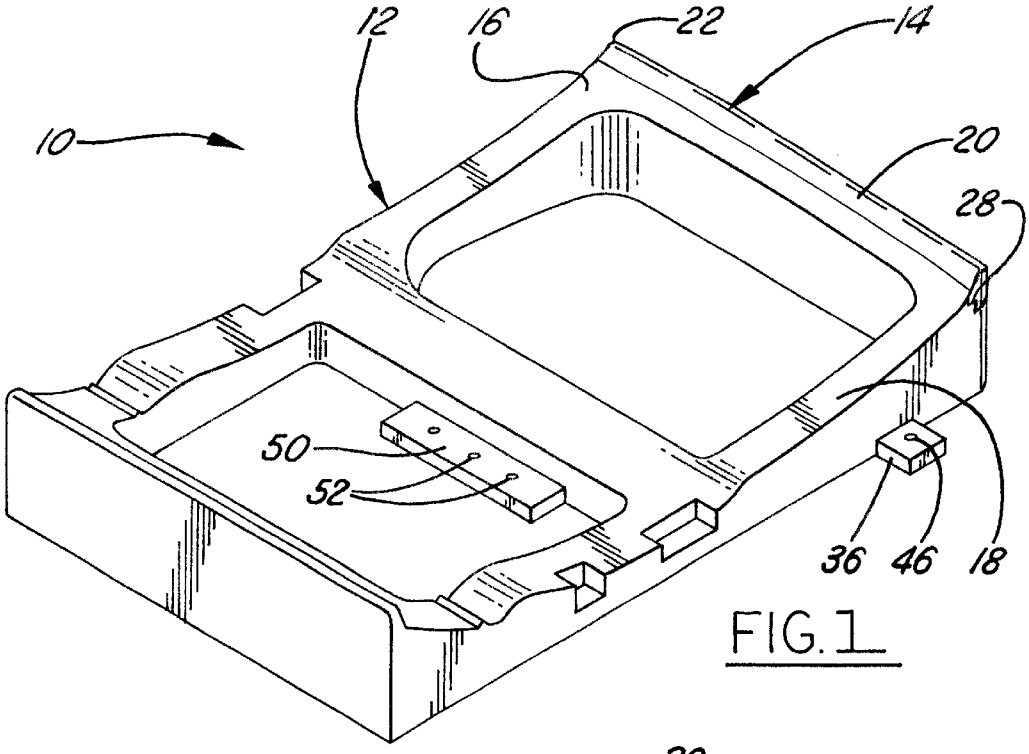
FIG. 1 is a top isometric view of a die post constructed according to the invention.

A first embodiment of a die post assembly constructed according to the invention is shown at 10 in FIGS. 1, 2, 6 and 7. A second embodiment of such a die post assembly is shown at 10' in FIG. 5. Reference numerals with the designation prime (') in FIG. 5 indicate alternative configurations of elements that also appear in the first embodiment. Unless indicated otherwise, where a portion of the following description uses a reference numeral to refer to the figures, that portion of the description applies equally to elements designated by primed numerals in FIG. 5.

The die post assembly 10 includes a panel support element 12 comprising a first material and an edge member 14 comprising a second material more durable than the first material. Upper surfaces of the panel support element 12 and edge member 14 together define a composite die post support surface 16 that supports and complements the shape of at least a portion of a metal panel to be flanged or hemmed. The die post support surface 16 supports the metal panel in such a way that a marginal edge portion of the metal panel overhangs or otherwise extends beyond an edge 22 of the die post support surface 16.

The die post support surface 16 includes an inner region 18 and a bearing region 20—the bearing region 20 being disposed adjacent the edge 22 of the die post support surface 16. The panel support element 12 includes the inner region 18 of the die post support surface 16. The edge member 14 includes the bearing region 20 of the die post support surface 16. The bearing region 20 is configured to complement the shape of a portion of the metal panel overlying the bearing region 20 and to support the overlying portion against deformation as the marginal edge portion of the metal panel is bent in a flanging or hemming operation. The edge member 14 is supported on the panel support element 12 and includes the bearing region 20 of the die post support surface 16. The edge member 14 is made of a second material more durable than the first material to enable the die post assembly 10 to support a series of metal panels against deformation over a large number of cycles without flowing as a result of such factors as heat or pressures generated in a hemming or flanging process.

The second material—used to form the edge member 14—preferably comprises a substance, such as steel, that can withstand a large number of hemming cycles. While many substances are sufficiently durable, the currently preferred substances are hardenable steels such as D2 oil-hardened tool steel and W2 water-hardened tool steel.

Figure 2:
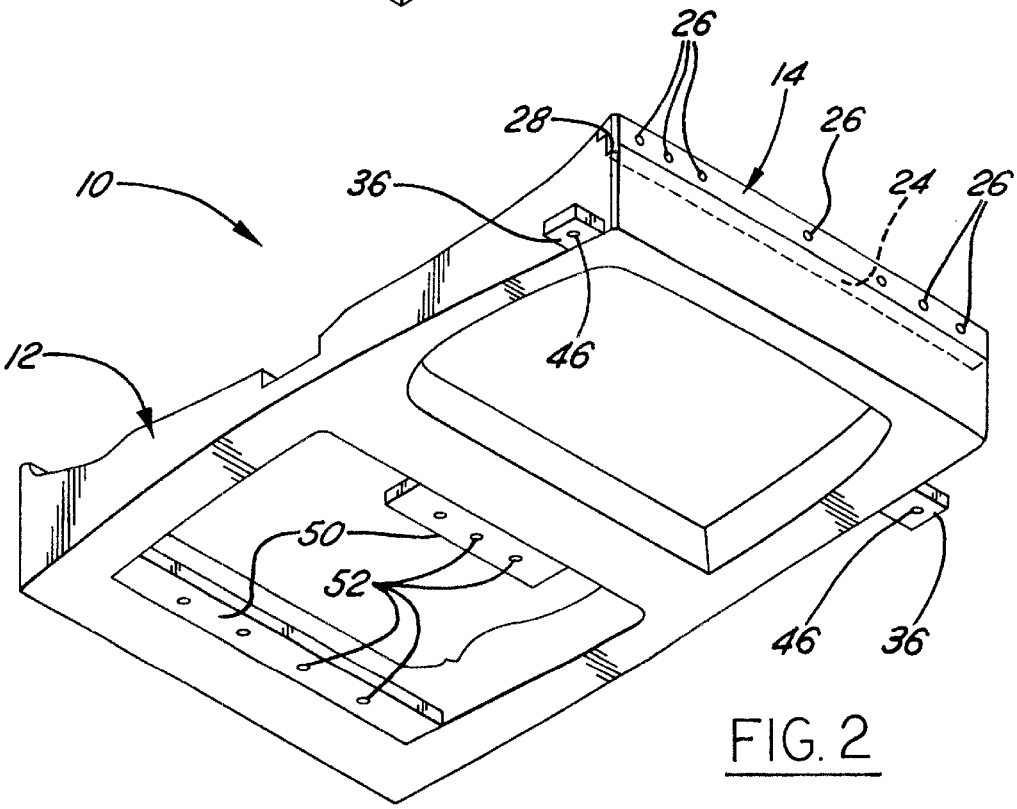
FIG. 2 is a bottom isometric view of the die post of FIG. 1.

As best shown in FIGS. 1 and 2, the edge member 14 has the general shape of an elongated rectangular prism. The contoured bearing region 20 is machined into an upper surface of the edge member 14. A base surface 24 of the edge member 14 is flat and is disposed generally perpendicular to a direction of hemming force application. Through-holes 26 extend through a thickness of the edge member 14 to allow the edge member 14 to be bolted into a generally rectangular notch 28 formed in the panel support element 12 and configured to receive the edge member 14.

Figure 5:
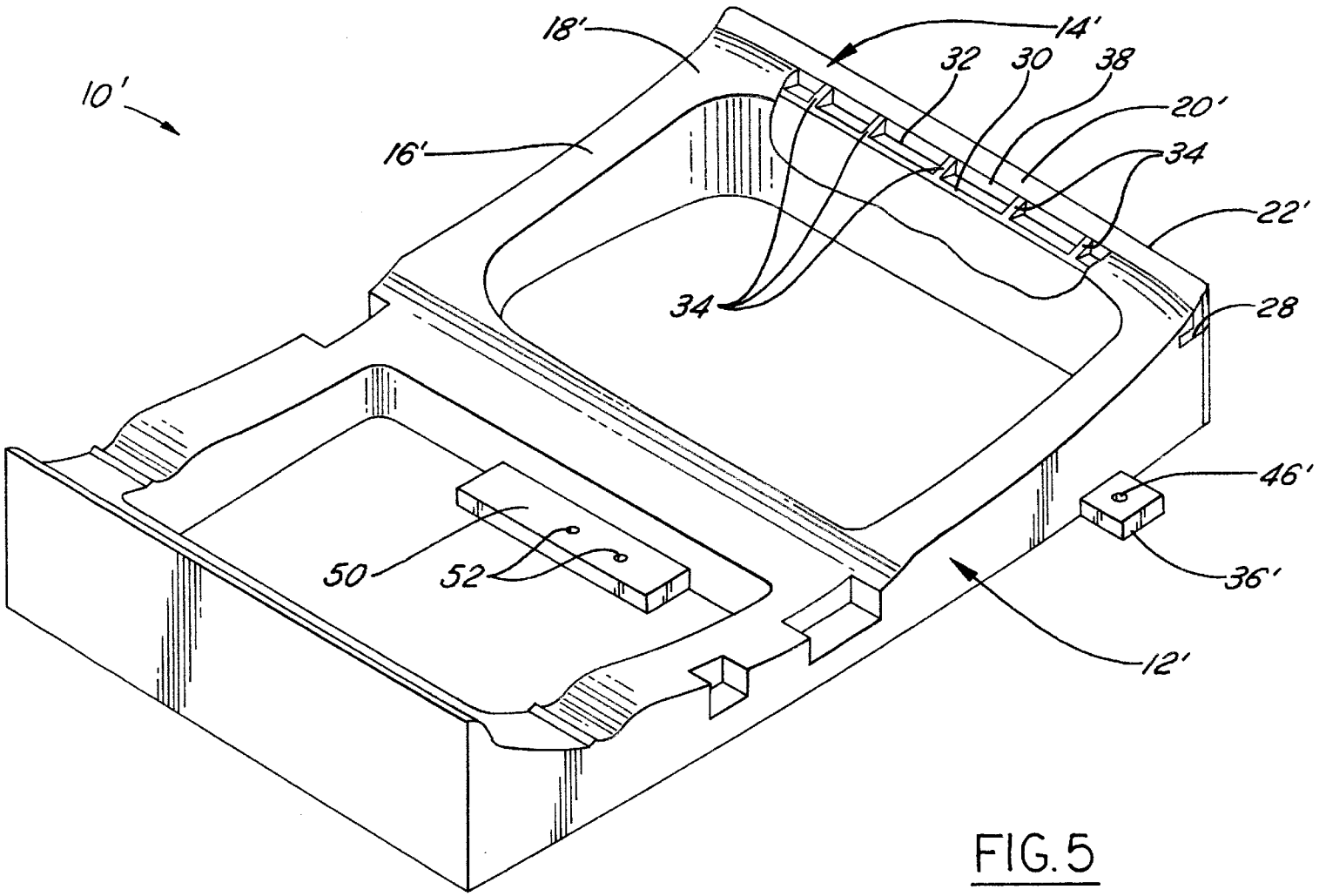
FIG. 5 is a partially cut-away front isometric view of a die post constructed according to the invention and including an alternative die post edge member configuration.

The notch 28 is shaped to complement the shape of the edge member 14 so.that the bearing region 20 of the edge member 14 lies flush with the portion of the die post support surface 16 defined by the panel support element 12. As shown in FIG. 5, the edge member 14 of a die post assembly 10' constructed according to the second embodiment of the invention includes a base flange 30 that extends integrally from along a base 32 of the edge member 14 in a direction generally perpendicular to a direction that force is applied to the edge member 14 during hemming or flanging. The base flange 30 increases the surface area over which the edge member 14 distributes hemming forces onto a supporting surface of the notch 28 formed in the panel support element 12. The notch 28 may either be formed to complement the shape of the base flange 30 or the edge member 14 may be insert molded with the panel support element 12. As is also shown in FIG. 5, the edge member 14 includes gussets 34 spaced along the length of the edge member 14 between an upright portion 37 of the edge member and the base flange 30 of the edge member 14. The gussets 34 help to evenly distribute hemming forces over the base flange 30.

The first material, i.e., the material used to form the panel support element 12, preferably comprises a substance, such as plastic, that is lighter in weight than the second material so that the die post assembly 10 can be more easily moved from one location to another without special lifting equipment. If the die post assembly 10 is not extremely large, it can also be lifted into position during assembly in a hemming apparatus and can be supported in a hemming apparatus without requiring heavy support members.

In applications where the panel support element 12 is constructed by casting the first material, it is also preferable that the first material be dimensionally stable. More specifically, the first material should be sufficiently dimensionally stable to allow immediate machining without having to relieve stresses within the panel support element 12 by waiting for the panel support element 12 to relax over an extended period of time. The panel support element 12 may be cast from any one of a number of suitable materials to include an unfilled cast polyurethane such as RP 6470 available from Ciba Specialty Chemicals Corporation a filled polyurethane such as RP 6470 using DT 082 filler—also available from Ciba Specialty Chemicals Corporation.

Where the panel support element 12 is constructed using plastic, any suitable plastic, such as filled or unfilled urethane may be used. In the embodiments shown in the drawings, the panel support element 12 comprises filled urethane tooling planks. Tooling planks are available under the trade name Pattern Planks® and the product designation PP1052 from Tool Chemical Company, Inc. Tooling planks are also available under the trade name Ren Shape and the product designation 5166 Metalforming Board from Ciba Specialty Chemicals Corporation.

Figure 6:
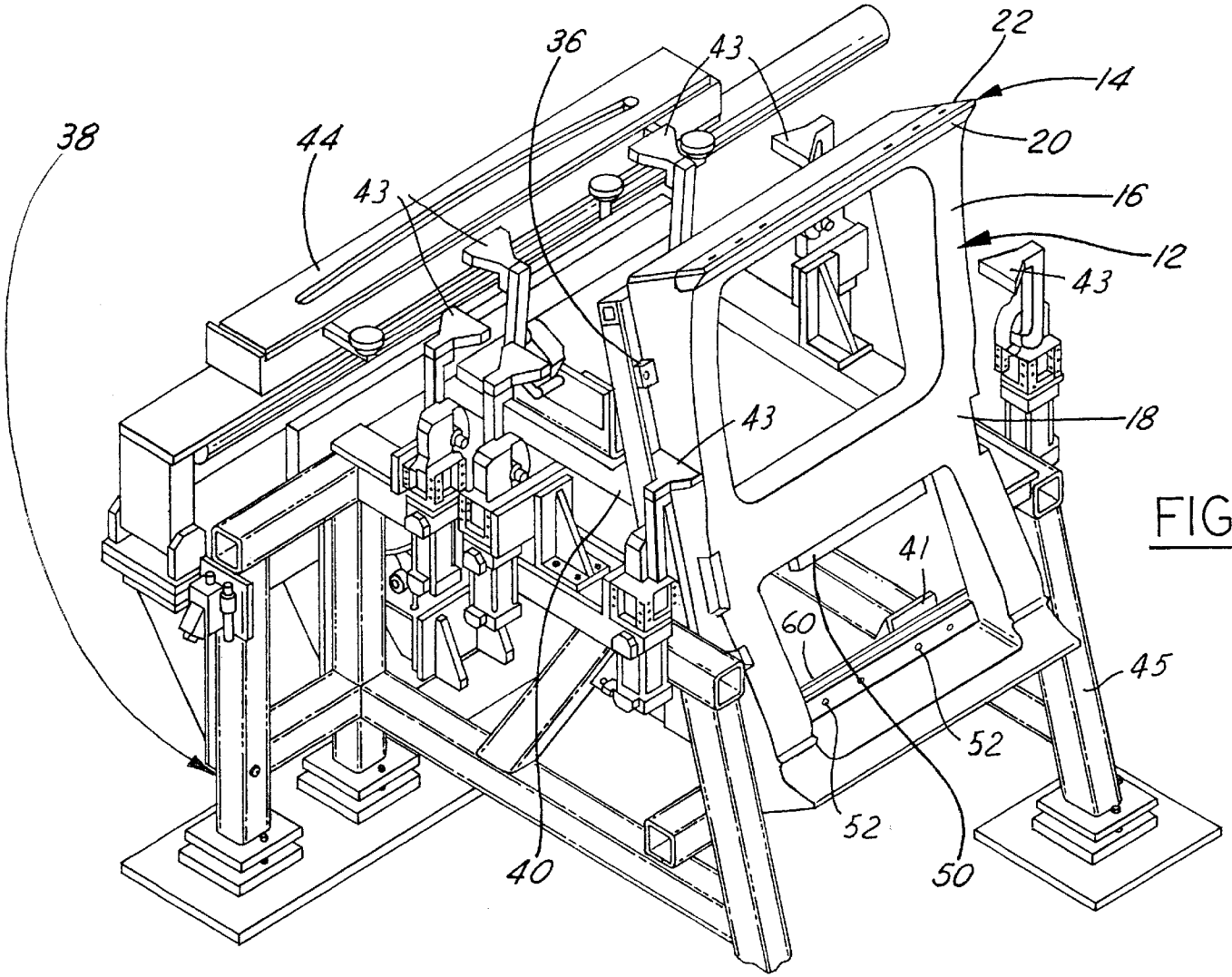
FIG. 6 is a perspective view of the die post of FIG. 1 supported on the die post support assembly of FIG. 3 in an upright panel loading/unloading position.
Figure 7:
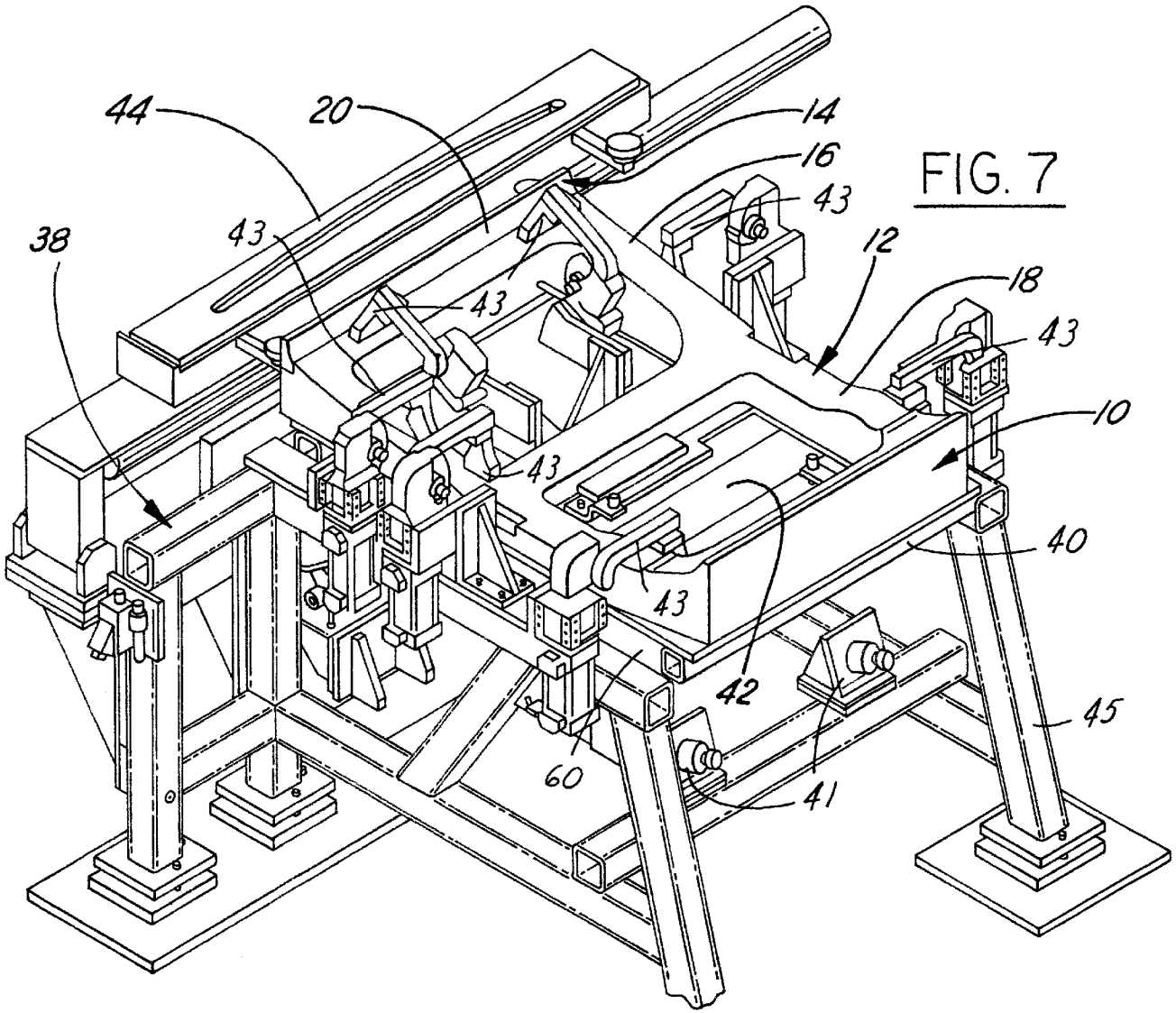
FIG. 7 is a perspective view of the die post of FIG. 1 supported on the die post support assembly of FIG. 3 in roll form or work position.

Two external steel mounting lugs 36 are supported on the panel support element 12 and are configured to attach the die post assembly 10 to a die post support assembly such as the one shown at 38 in FIGS. 6 and 7. As shown in FIGS. 3, 4, 6 and 7, each of the mounting lugs 36 includes a through hole 46 through which a fastener may be extended to connect the mounting lugs to one of a number of threaded holes 48 in the die post support assembly 38.

The die post support assembly, shown at 38 in FIGS. 3, 4, 6, 7 and 8 is configured to support a die post assembly 10 constructed according to the invention as is best shown in FIGS. 6 and 7. The die post support assembly 38 is constructed to allow an installer to attach a die post assembly 10 to a die mount table 40 of the support assembly 38 in a vertical or inclined "up" position shown in FIG. 6. The die post assembly 10 is held in place on the die mount table 40 by fasteners that are inserted through the holes 36, 52 in the mounting lugs 46, 50 and then through corresponding holes in the die mount table 40.

Figure 3:
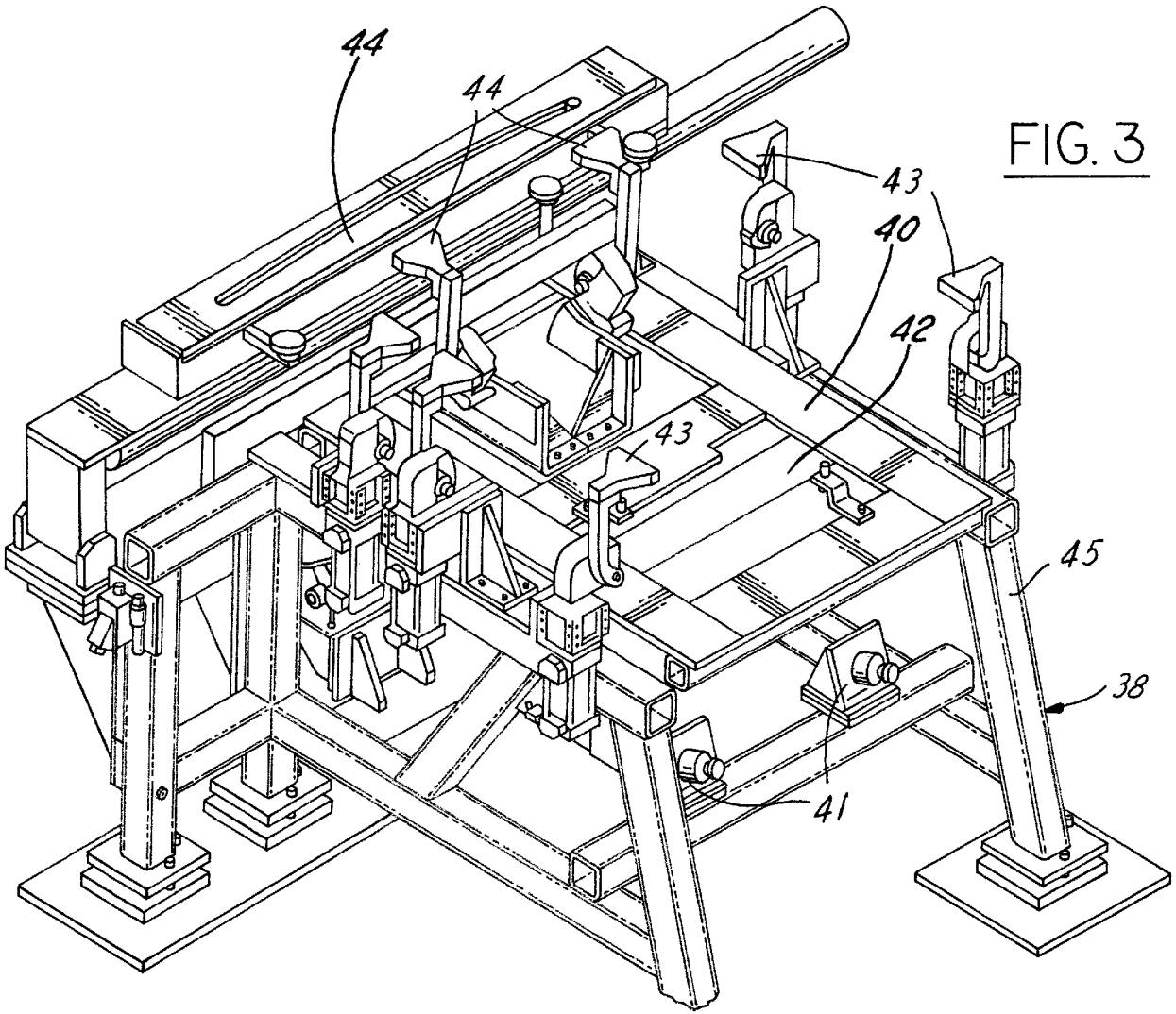
FIG. 3 is a perspective view of a die post support assembly constructed according to the invention.
Figure 8:
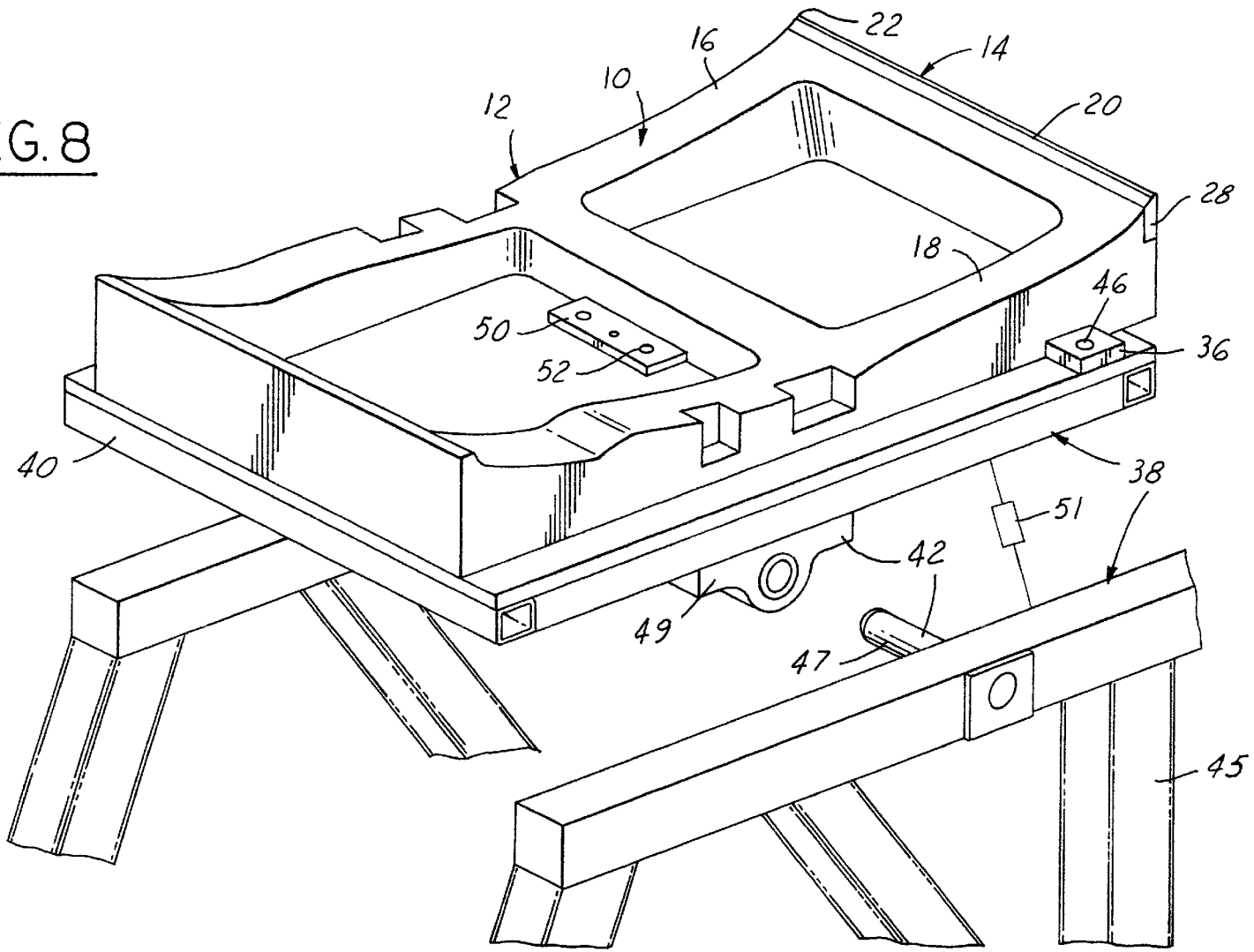
FIG. 8 is a partial schematic perspective view of the die post assembly of FIG. 3 supported on a die post support assembly constructed according to the invention and with a die mount table of the die post support assembly shown disassembled from a support frame portion of the die post support assembly.

The die post support assembly 38 includes a pivot 42 that pivotally supports the die mount table 40 on a support frame 45 portion of the die post support assembly 38. As is best shown in FIG. 8, the pivot 42 includes a pair of pivot shafts 47 that extend axially inward toward each other from opposite sides of the support frame 45. The pivot shafts 47 are journalled within respective pivot bearings 49 attached to a back side of the die mount table 40. The pivot 42 allows the die mount table 40 and an attached die post assembly 10 to be pivoted into a work position, as shown in FIG. 7, to support a panel for hemming or flanging. An air cylinder 51 connected between the die mount table 40 and the support frame 45 drives the die mount table 40 between the up and work positions. To prevent damage to the die post assembly 10 when the die post assembly 10 and die mount table 40 are pivoted from the work position to the up position, a pair of shock absorbers 41 are attached to the support frame 45 as best shown in FIG. 3. The shock absorbers 41 are positioned to engage a downwardly pivoting portion 60 of the die mount table 40 when the die mount table 40 is pivoted to the up position.

Figure 4:
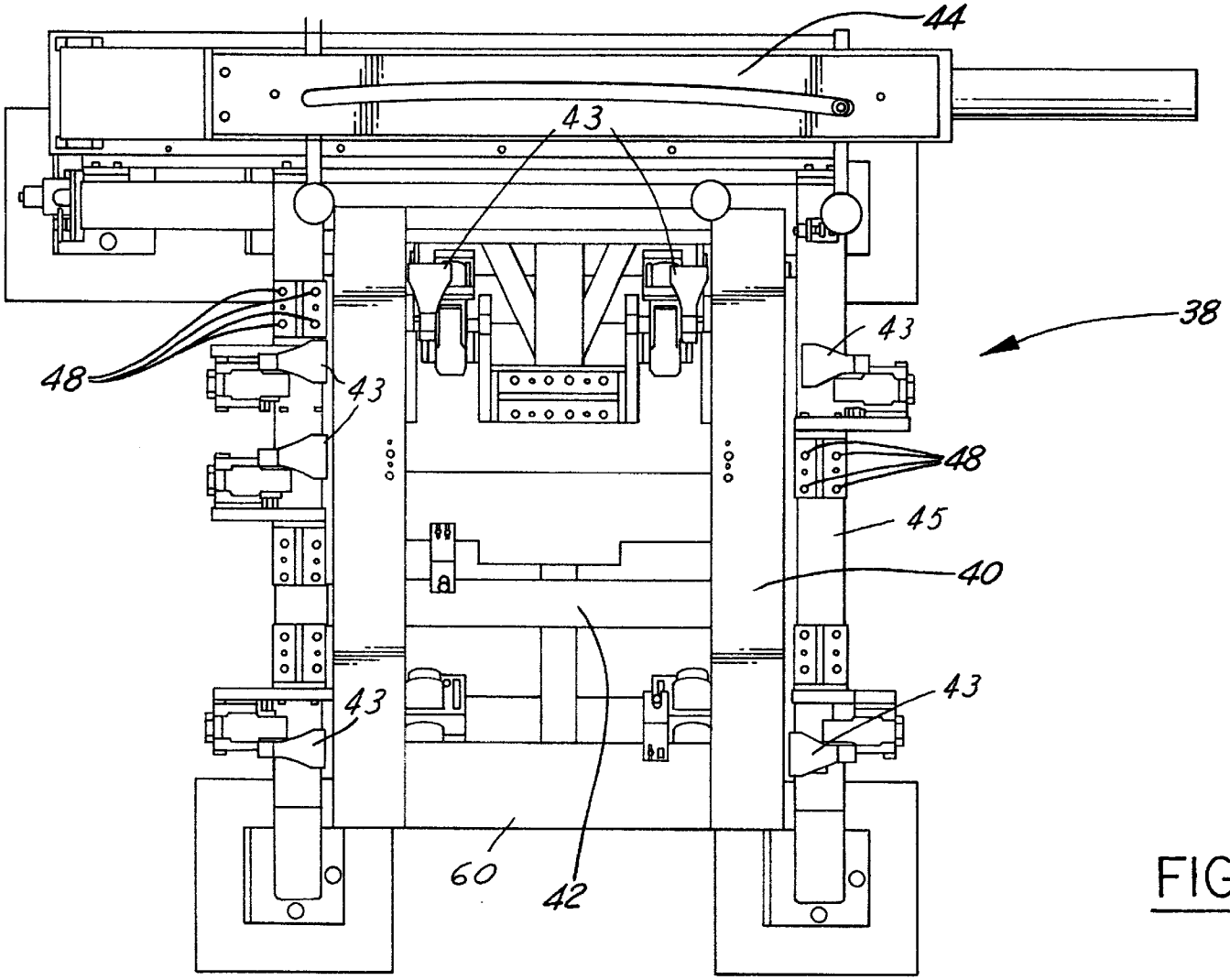
FIG. 4 is a plan view of the die post support assembly of FIG. 3.

The die post support assembly 38 also includes five clamps 43 that are pivotally supported around an outer peripheral edge of the die mount table 40 for movement between an upright released position as shown in FIGS. 3, 4 and 6 and a generally horizontal clamped position as shown in FIG. 7. The clamps 43 are configured to secure and positively locate a panel on the die post assembly 10 for hemming or flanging. The clamps 43 are pivoted to their respective released positions to remove a hemmed panel, to place a panel on the die post assembly 10 for hemming or flanging, and to rotate the die mount table 40 and any attached die post assembly 10 to the up position as described above. The die post support assembly 38 also supports a hemming cam and roller assembly 44 in a position to hem a panel supported on the die post.

Internal steel mounting lugs 50 are supported on the panel support element 12 and are configured to either secure metal panels to the die post for hemming or to receive fasteners for retaining the die post assembly 10 on the die post support assembly 38. The lugs 50 include through-holes 52 positioned to connect either directly to a panel to be hemmed, the die post support assembly 38 or to attach clamps and other devices adapted to position and/or hold a panel in place during hemming or flanging.

While the die post support assembly 38 shown in FIGS. 3, 4, 6 and 7 is especially suited for supporting a die post assembly 10 constructed according to the invention, a die post assembly 10 constructed according to the invention may also be used in existing hemming machinery in place of conventional iron die posts. In addition, when using a suitable steel edge member 14, a die post assembly 10 constructed according to the invention is suitable for use in the same hemming and flanging applications as an iron die post, e.g., for use in both roll-edge and hammer-edge hemming machines.

According to the invention, a die post assembly 10 can be made by constructing the panel support element 12 from tooling planks. The tooling planks are cut a desired size and shape then joined together in a layered disposition to form a plank stack by known means such as adhesives or fasteners. The plank stack is then cut using band saws and/or other suitable implements such as machine tools to form a rough approximation of the desired shape of a support surface 16. This reduces the amount of shaping that must subsequently be accomplished to cause the support surface 16 to more closely complement the shape of panels to be hemmed. The support surface 16 is then shaped to within predetermined tolerances. Shaping may be accomplished by any suitable means to include machining—which may be accomplished using a computer numeral control (CNC). The rectangular notch is then formed into the panel support element 12 by machining or other suitable means.

Alternatively, the panel support element 12 may be formed by casting the first material into a shape that at least roughly approximates a desired support surface shape. The support surface 16 is then further shaped to within predetermined tolerances. Further shaping may be accomplished by machining which, again, may be accomplished using a CNC machine. The edge member 14 may alternatively be cast in place in the panel support element 12 rather than forming a notch and attaching the edge member 14 after casting.

The edge member 14 may be formed by first providing an elongated member comprising the second material, then shaping at least one surface of the elongated member to form the bearing region 20 of the die post support surface. Again, shaping is preferably accomplished by machining using a CNC machine. Where more than one edge of a panel is to be hemmed or where the entire peripheral edge of a panel is to be hemmed, several elongated members are formed and are preferably joined together by welding or other suitable means. Resulting weld joints between edge members 14 are preferably machined to within tolerances established for the bearing region 20.

After the edge member 14 and panel support element 12 have been formed, the edge member 14 is attached to the panel support element 12. After the notch 28 in the panel support element 12 has been formed, the edge member 14 is deposited in the notch 28 and is fastened in place by bolting or other suitable means. Before bolting an edge member 14 in place, the holes 26 must be formed by drilling or other suitable means at spaced locations along the edge member 14 and in corresponding spaced locations within and along the length of the notch 28.

The above description and the attached appendix are intended to illustrate certain embodiments of the invention rather than to limit the invention. Therefore descriptive rather than limiting words are used. Obviously, it's possible to modify this invention from what the description discloses. One may practice the invention other than as described.

What is claimed is:

1. A die post assembly for supporting a thin metal panel in a position to allow a forming implement to flange, pre-hem, or hem a marginal edge portion of the panel; the assembly comprising:

a panel support element comprising a first cast material and configured to support a metal panel as a marginal edge portion of the metal panel is bent along a bend line in a flanging, pre-hemming, or hemming operation; and an edge member supported on the edge of the panel support element and configured to support an overlying portion of the panel along the bend line during flanging, pre-hemming, or hemming, the edge member having a shape that compliments the shape of the panel and having a top surface that lies flush with the adjacent top surface of the panel support element, the edge member comprising a second material more durable than the first material to enable the die post to support a series of metal panels in a flanging, pre-hemming or hemming operation over a large number of cycles without flowing or deforming the die post, wherein the first material is lighter in weight than the second material and the first material is sufficiently dimensionally stable to allow machining immediately after casting and hardening.

2. A die post assembly as defined in claim 1 in which the first material comprises plastic.

3. A die post assembly as defined in claim 1 in which the first material comprises one or more materials from a group of materials including filled urethane and unfilled urethane.

4. A die post assembly as defined in claim 1 in which the panel support element comprises filled urethane tooling planks.

5. A die post assembly as defined in claim 1 in which the panel support element comprises an unfilled cast polyurethane.

6. A die post assembly as defined in claim 1 in which the panel support element comprises a filled cast polyurethane.

7. A die post assembly as defined in claim 1 in which the second material comprises steel.

8. A die post assembly as defined in claim 7 in which the second material comprises D2 oil-hardened tool steel.

9. A die post assembly as defined in claim 7 in which the second material comprises W2 water-hardened tool steel.

10. A die post assembly as defined in claim 1 in which the panel support element includes a notch configured to receive the edge member.

11. A die post assembly as defined in claim 1 in which the bearing region of the edge member lies flush with the portion of the die post support surface defined by the panel support element.

12. A die post assembly as defined in claim 1 in which the edge member includes a base flange that extends integrally from along a base of the edge member in a direction generally perpendicular to a direction that force is applied to the edge member during hemming or flanging.

13. A die post assembly as defined in claim 1 in which the edge member includes gussets spaced along the length of the edge member between an upright portion of the base member and the base flange of the edge member.

14. A die post assembly for supporting a thin metal panel in a position to allow a forming implement to bend a marginal edge portion of the panel in a flanging, pre-hemming or hemming operation; the assembly comprising:

a panel support element comprising a plastic element configured to support a metal panel as a marginal outer edge portion of the panel is bent along a bend line of the panel; and an outer edge member supported on the panel support element and configured to support an overlying portion of the panel along the bend line during flanging, pre-hemming, or hemming as the marginal outer edge portion of the panel is bent, the outer edge member comprising a metallic material and the panel support element comprising a non-metallic material that is lighter, easier to form, and quicker to dimensionally stabilize than metallic material.

15. A die post assembly as defined in claim 14 in which the panel support element comprises one or more materials from a group of materials including filled urethane and unfilled urethane.

16. A die post assembly as defined in claim 14 in which the panel support element comprises filled urethane tooling planks.

17. A die post assembly as defined in claim 14 in which the panel support element comprises an unfilled cast polyurethane.

18. A die post assembly as defined in claim 14 in which the panel support element comprises a filled cast polyurethane.

19. A die post assembly as defined in claim 14 in which the second material comprises steel.

* * * * *